US007103291B2

(12) United States Patent
Odani

(10) Patent No.: US 7,103,291 B2
(45) Date of Patent: Sep. 5, 2006

(54) PRINTING DEVICE AND PRINTING PROGRAM

(75) Inventor: Makoto Odani, Mishma (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 11 days.

(21) Appl. No.: 10/922,941

(22) Filed: Aug. 23, 2004

(65) Prior Publication Data

US 2006/0039709 A1 Feb. 23, 2006

(51) Int. Cl.
*G03G 15/08* (2006.01)

(52) U.S. Cl. ..... 399/27; 399/30; 399/61; 399/120; 399/258; 399/262

(58) Field of Classification Search ..... 399/27, 399/258, 30, 58, 61, 120, 262
See application file for complete search history.

(56) References Cited

U.S. PATENT DOCUMENTS 6,381,420 B1 * 4/2002 Sato et al. ..... 399/27
6,687,477 B1 * 2/2004 Ichida et al. ..... 399/237
6,856,779 B1 * 2/2005 Ota et al. ..... 399/262
2004/0091275 A1 * 5/2004 Matsuda et al. ..... 399/27

FOREIGN PATENT DOCUMENTS

JP 5-204244 A 8/1993
JP 06274031 A * 9/1994

* cited by examiner

*Primary Examiner*—Arthur T. Grimley
*Assistant Examiner*—Joseph S. Wong
(74) *Attorney, Agent, or Firm*—Foley & Lardner LLP

(57) ABSTRACT

A printing device is capable of externally detecting: (a) a toner concentration in a developing unit; and (b) a reduction in the usable amount of toner. This eliminates the conventional need of disposing the toner concentration sensor in a narrow developing unit or the need of disposing the toner remaining amount detection sensor in the toner supply unit. Further, it is possible to detect reduction in the amount of toner every time the toner in the developing unit is out, thereby detecting reduction in the usable amount of toner stepwise and issuing an adequate warning whose level is changed depending on the detection result. Thus, the printing device meets the need for miniaturization and is capable of favorably performing printing operation and maintenance work.

17 Claims, 6 Drawing Sheets

PRINTING DEVICE AND PRINTING PROGRAM

BACKGROUND OF THE INVENTION

1. Field of the Invention

The present invention relates to a printing device using toner, and more particularly, to a printing device having a cartridge type toner supply unit detachably attached thereto. The toner supply unit supplies a developing unit with the toner stored therein in two steps, and detects a reduction in a toner amount at each of the steps.

2. Description of the Related Art

A prior art printing device of this type is disclosed in, for example, a patent document (Japanese Patent Laid-Open No. 5-204244 (Abstract, pages 4 to 7, FIGS. 1 and 2)). The printing device of this example: (a) has a toner concentration sensor attached to a toner circulation passage in a developing unit so as to detect a toner concentration in the developing unit, (b) supplies the developing unit with the toner from a first toner container so that a toner concentration within the developing unit maintains a desired concentration level, and (c) supplies the first toner container with the toner from a second toner container provided separately from a main body of the device so that adequate toner amount is maintained in the first toner container. In this case, two toner remaining amount detection sensors are so disposed on an outer wall of the first toner container as to be located in different positions in terms of height to detect stepwise excess or deficiency of a toner amount in the first toner container. Thus, it is possible to cope with the rapid change in a rate of toner supply from the first toner container to the developing unit.

The aforementioned conventional printing device supplies the developing unit with an adequate amount of the toner from the first toner container by disposing the toner concentration sensor within the developing unit to thereby maintain a toner concentration within the developing unit at a desirable level. Further, by disposing the two toner remaining amount detection sensors on an outer wall of the first toner container the printing device can adequately cope with the case where a rate of toner supply to the developing unit must be rapidly changed. However, in some cases, it is impossible to dispose the toner concentration sensor in the developing unit or it is impossible to provide the second toner container separately from a main body of the device due to the need for miniaturization. Specifically, when a configuration in which a cartridge type toner supply unit having first and second toner storage rooms is fit to a main body is used as a substitution for the conventional first and second toner containers to realize miniaturization, it is very difficult to dispose the toner remaining amount detection sensors in the first and second toner storage rooms.

Therefore, a technique for detecting a toner remaining amount with high reliability even in the case where the toner concentration sensor cannot be disposed in the developing unit or the toner remaining amount detection sensor cannot be provided in the toner storage room becomes necessary. Specifically a technique that can effectively detect a state in which the toner is near-empty.

SUMMARY OF THE INVENTION

The present invention has been made to solve the above problems and an object thereof is to provide a printing device and its program capable of detecting a near-empty state with high reliability even in the case where a toner concentration cannot be directly detected in the developing unit, thereby easily advancing the miniaturization and integration of the printing device, and capable of favorably performing printing operation and maintenance work.

To solve the above problem, according to an aspect of the present invention, there is provided a printing device comprising: an electrostatic latent image forming unit that forms an electrostatic latent image of the image to be printed; a developing unit that develops the electrostatic latent image formed by the electrostatic latent image forming unit using retaining toner while being supplied with toner; a toner concentration sensor that can detect the concentration of the toner retained in the developing unit; a cartridge type toner supply unit attached to the printing device in a detachable manner having first and second toner storage rooms each of which stores toner, a first toner supply mechanism that can feed the toner stored in the first toner storage room to the developing unit, and a second toner supply mechanism that can feed the toner stored in the second toner storage room to the first toner storage room; and a controller that selectively performs first and second operations, the first operation including driving the first toner supply mechanism to feed the toner stored in the first toner storage room to the developing unit based on the toner concentration detected by the toner concentration sensor, and the second operation including driving the second toner supply mechanism to feed the toner stored in the second toner storage room to the first toner storage room.

According to another aspect of the present invention, there is provided a printing program executed by a computer of the printing device including: a developing unit that develops the electrostatic latent image formed by the electrostatic latent image forming unit using retaining toner while being supplied with toner; a toner concentration sensor that can detect the concentration of the toner retained in the developing unit; and a cartridge type toner supply unit attached to the printing device in a detachable manner having first and second toner storage rooms each of which stores toner, a first toner supply mechanism that can feed the toner stored in the first toner storage room to the developing unit, and a second toner supply mechanism that can feed the toner stored in the second toner storage room to the first toner storage room, the program allowing the computer of the printing device to execute: a concentration detection step of detecting a toner concentration using the toner concentration sensor; a toner supply step of selectively performing first and second operations based on the toner concentration detected in the concentration detection step, the first operation including driving the first toner supply mechanism to feed the toner stored in the first toner storage room to the developing unit, and the second operation including driving the second toner supply mechanism to feed the toner stored in the second toner storage room to the first toner storage room.

DETAILED DESCRIPTION OF THE PREFERRED EMBODIMENTS

An embodiment of the present invention will be described below with reference to the accompanying drawings.

Figure 1:
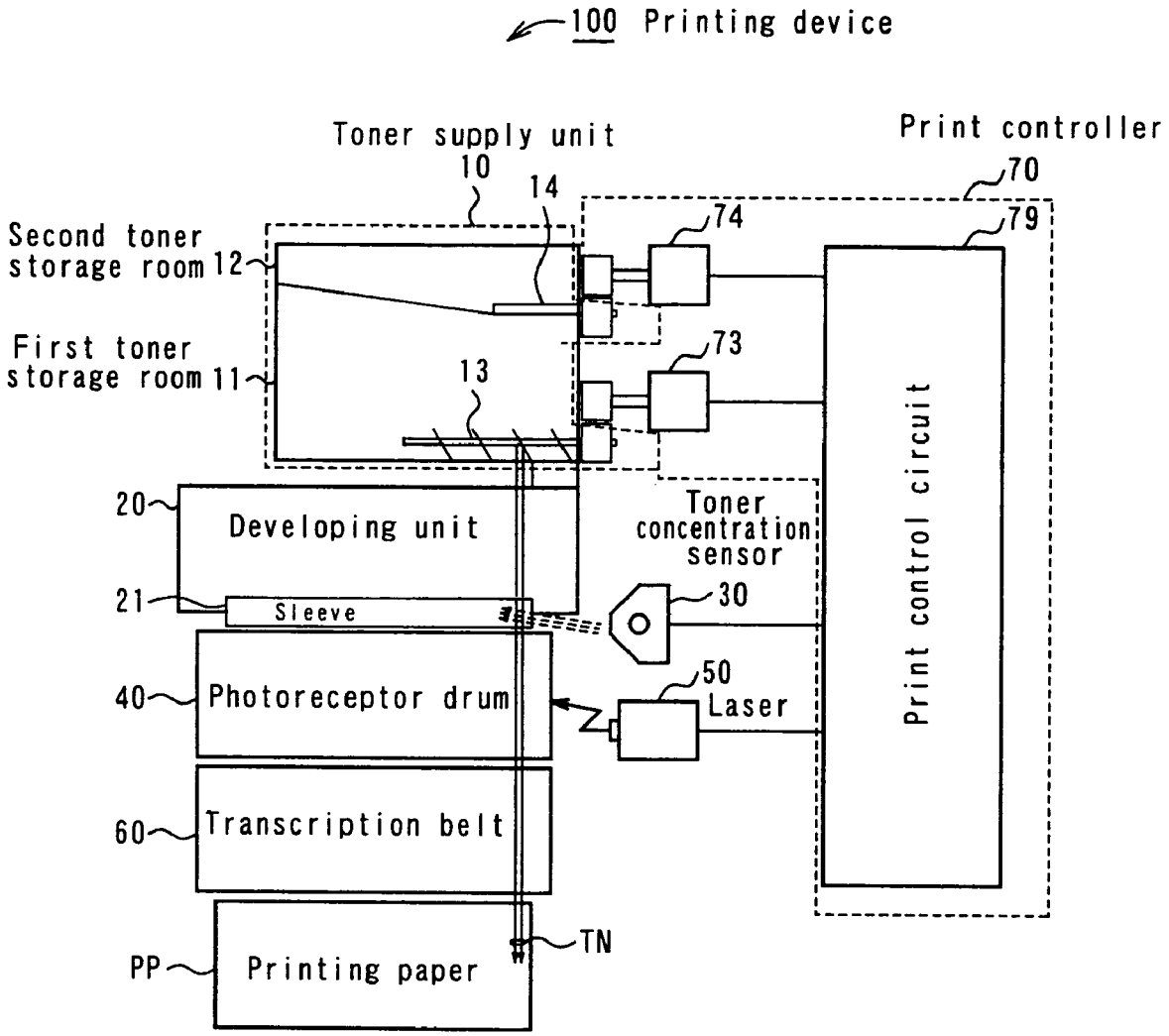
FIG. 1 is a view showing a configuration of a printing device according to an embodiment of the present invention.

A printing device shown in FIG. 1 includes: a cartridge type toner supply unit 10 having toner supply mechanisms 13 and 14; a developing unit 20; a toner concentration sensor 30 for measuring a toner concentration on a sleeve 21 of the developing unit 20 to detect the toner concentration level in the developing unit 20; a photoreceptor drum 40 and laser 50 which constitute an electrostatic latent image forming unit; a transcription belt 60 which constitutes a paper-printing processing unit; and a print controller 70 having a print control circuit (corresponding to a controller of the present invention) 79 which controls the above components 10 to 60 and first and second mechanism driving units 73 and 74 so as to realize a printing of a desirable image on a paper.

Figure 5:
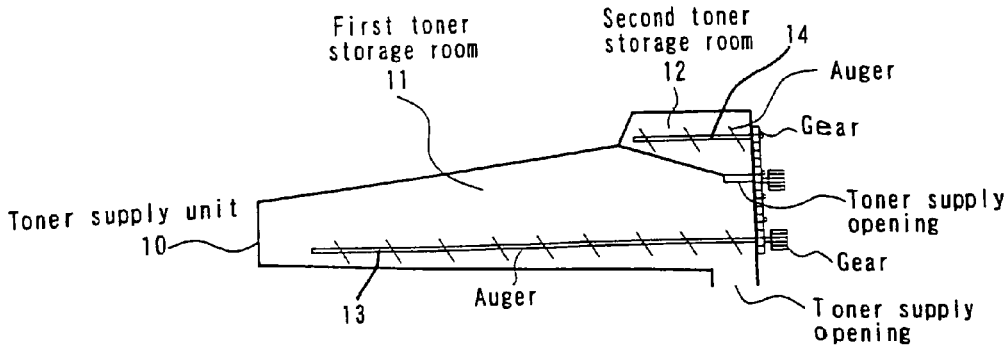
FIG. 5 is a view showing a first example of the toner supply unit shown in FIG. 1.

In the above case, the toner supply unit 10 is attached to the printing device in a detachable manner and the inside thereof is partitioned into first and second toner storage rooms 11 and 12 in such a manner that each of the two storage rooms can store toner. Provided in the first toner storage room 11 is the first toner supply mechanism 13 that can feed a toner TN to the developing unit 20 from a toner supply opening of the first toner storage room 11. Further, provided in the second toner storage room 12 is the second toner supply mechanism 14 that can feed toner to the first toner storage room 11 from a toner supply opening of the second toner storage room 12. The toner supply unit 10 can have any of the various configurations shown in FIGS. 5 to 8. The following description is made assuming that the toner supply unit 10 in this example is configured as shown in FIG. 5.

The first toner supply mechanism 13 includes an auger to stir and feed the toner in the first toner storage room 11. The auger has a gear attached to the terminal thereof. When driving is supplied from a gear of the first mechanism driving unit 73 in the print controller 70, the auger stirs toner and feeds the toner TN to the toner supply opening facing the developing unit 20. The second toner supply mechanism 14 includes an auger to stir and feed the toner in the second toner storage room 12. The auger has a gear attached to the terminal thereof. When driving is supplied from a gear of the second mechanism driving unit 74 in the print controller 70, the auger stirs and feeds toner to the toner supply opening facing the first toner storage room 11.

The developing unit 20, while being supplied with the toner from the first toner supply mechanism 13, develops, using the stored toner, an electrostatic latent image formed by the electrostatic latent image forming unit including the photoreceptor drum 40, laser 50, and the like. Paper-printing processing of the developed image including transcription of the image to a printing paper PP and fixing is then performed with the transcription belt 60, a fuser (not shown), and the like. The concentration of the toner stored in the developing unit 20 is detected by the toner concentration sensor 30 that measures a toner concentration on the sleeve 21. The electrostatic latent image to be sent to the photoreceptor drum 40 is formed by the laser 50 using image data from the print control circuit 79.

Figure 2:
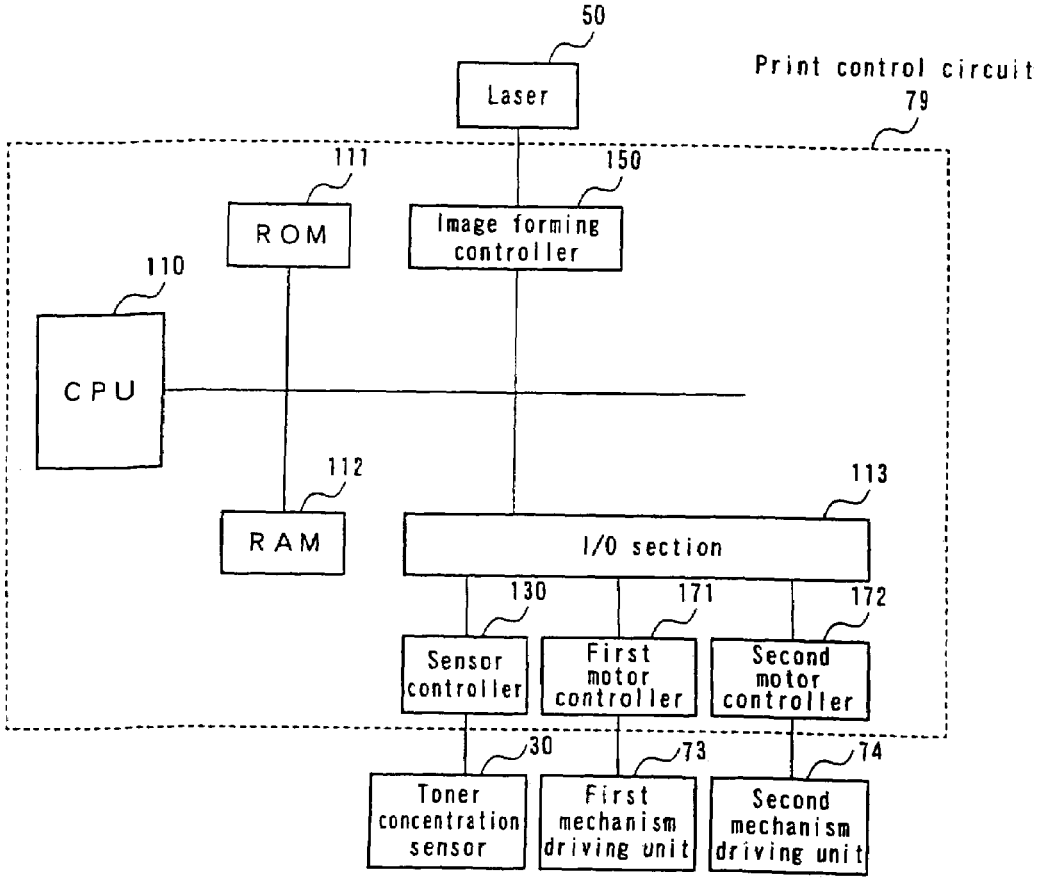
FIG. 2 is a block diagram schematically showing a print control circuit of the printing device shown in FIG. 1.

FIG. 2 schematically shows a configuration of the print control circuit 79. In the print control circuit 79, a CPU 110 uses a control program stored in an ROM 111, a function of an RAM 112, and the like to read out a toner concentration in the developing unit 20 from the toner concentration sensor 30 through an I/O section 113, a sensor controller 130, and first and second motor controllers 171 and 172, and then activates the first and second mechanism driving units 73 and 74. Further, the CPU 110 drives the laser through an image forming controller 150 to form an electrostatic latent image. That is, the print control circuit 79 controls the first mechanism driving unit 73 such that the toner concentration in the developing unit 20 that has been read out from the toner concentration sensor 30 becomes equal to or higher than a specified toner concentration. When the toner stored in the first toner storage room 11 of the toner supply unit 10 has been used to some extent, the print control circuit 79 controls the second mechanism driving unit 74 so as to move toner from the second toner storage room 12 to the first toner storage unit to continue toner supply from the first toner storage room 11 to the developing unit 20. In this case, an alarm is issued based on the degree of toner consumption every time the amount of the toner in the first toner storage room 11 is reduced.

Figure 3:
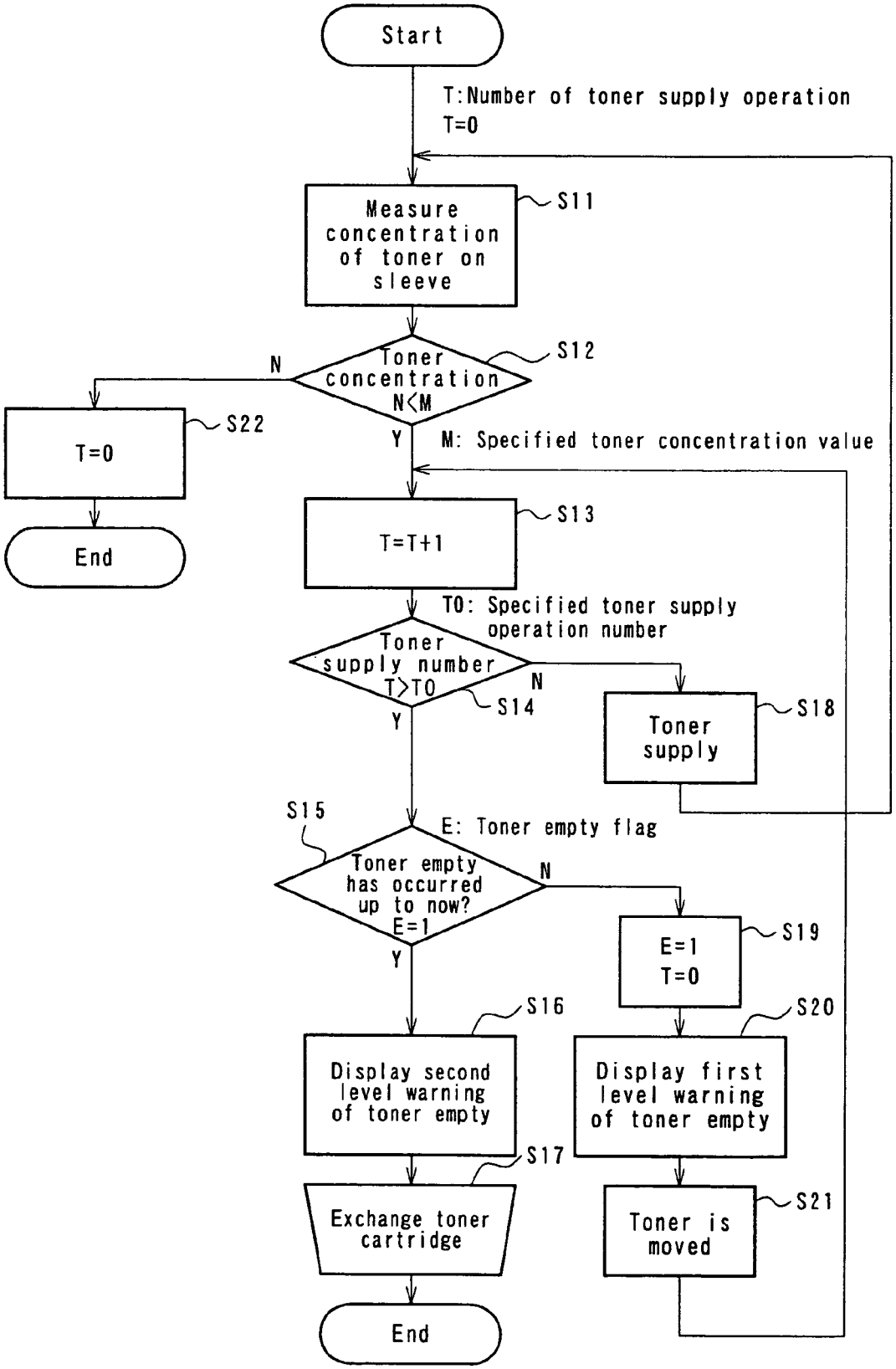
FIG. 3 is a flowchart for explaining control operation of the printing device shown in FIG. 1.

A toner supply control operation performed by the print controller 70 of the printing device 100 will next be described with reference to FIGS. 3 and 4. When the printing device 100 is started at time t0 (FIG. 4), the print control circuit 79 of the print controller 70 executes a toner supply control operation at a predetermined cycle. More specifically, the print control circuit 79 measures a concentration N of the toner existing on the sleeve 21 using the toner concentration sensor 30 as time t1 (S11). Based on the measurement result, the print control circuit 79 determines whether the concentration N of the toner stored in the developing unit 20 is less than a specified toner concentration M, that is N<M (S12). When determining that the toner concentration N is not less than the toner concentration M, that is, N≧M (N≧M at time t1), which means that sufficient toner exists in the developing unit 20 and therefore it is not necessary to supply the developing unit 20 with toner from the first toner storage room 11, the print controller 70 does not perform toner supply but sets the number T of toner supply at "0" (S22). After that the print control circuit 79 ends the current control cycle and waits for the next control cycle.

On the other hand, when it has been determined in step S12 that the toner concentration N is less than the toner concentration M, that is, N<M (for example, at times t2, t3, t4 . . . ), the print controller 70 increments data of the toner supply number T by "1" (S13) and compares the data of the toner supply number T that has been incremented by "1" with a specified toner supply number T0 to determine whether T>T0 (S14). When determining that T>T0 is not satisfied, which means that toner may exist in the first toner storage room 11, the print controller 70 activates the first mechanism driving unit 73 to drive the first toner supply mechanism 13, thereby allowing the first toner supply mechanism 13 to supply the developing unit 20 with a predetermined amount of the toner from the first toner storage rooms 11 (S18) and then returns to step S11.

Therefore, assuming that toner exits in the first toner storage room 11, toner supply is normally performed, and the toner concentration becomes N>M, the print controller 70 advances to step S22 through the steps S11 and S12. The case where the toner supply is normally operated as described above is represented by time t0 to t2, time t2 to t3, time t3 to t4, and the like in FIG. 4. The operation described above corresponds to a first operation of the present invention.

However, when there is no toner left in the first toner storage room 11, steps S11 to S18 are repeated. Finally, in step S14, it is determined that T>T0. Since the toner concentration has not been increased in spite of the toner supply operation repeated by a specified number T0 (see, for example, time t5 to t10, time t15 to t18 in FIG. 4), it has been determined in this case that there has been no toner left in the first toner storage room 11. The print control circuit 79 then checks an empty flag E (set in the print controller 70) from the time point at which the current toner supply unit 10 has been attached to the printing device 100. That is, the print control circuit 79 determines whether toner has been moved from the second toner storage room 12 to the first toner storage room 11 since the current toner supply unit 10 has been attached to the printing device 100 based on whether the empty flag E is "1" or not (S15; toner is stored in the second toner storage room 12 shown in FIG. 4 from time t0 to time t10 during which the empty flag at that time is "0" and the empty flag becomes "1" at time t10 or later).

When it has been determined in step S15 that the empty flag E is not "1" (time t5 to t10 in FIG. 4), the print control circuit 79 recognizes that toner is retained in the second toner storage room 12 of the toner supply unit 10. Then the print control circuit 79 allows the empty flag E to be "1" and sets the toner supply number T at "0" (S19). Subsequently, the print control circuit 70 issues a first level warning (slight warning) of toner empty (S20), activates the second mechanism driving unit 72 to drive the second toner supply mechanism 14, thereby allowing the second toner supply mechanism 14 to move the toner retained in the second toner storage room 12 to the first toner storage room 11 (S21; all toner is moved to the first toner storage room 11 at once in this example), and returns to step S13. The operation described above corresponds to a second operation of the present invention.

Accordingly, at time t10, the toner concentration N to be detected by the toner concentration sensor 30 becomes higher than the toner concentration M (N>M) as in the case of the state at time t0, and the procedure advances to step S22 through the steps S13, S14, S18, S11 and S12. The first level warning is displayed on a display unit of the printing device, for example, with blinking characters or warning-colored characters. Alternatively, the first level warning is issued by voice independently from or with the characters.

When determining in step S15 that the empty flag E is "1", (time t15 to t18 in FIG. 4), which means that there is no toner left also in the second toner storage room 12, the print control circuit 79 issues a second level warning of toner empty indicating that an attachment of a new toner supply unit 10 is necessary (S16). The second warning is so heavy that the printing operation is prohibited simultaneously with the second level warning depending on the setting. As is the case with the first level warning, the second level warning is displayed on a display unit of the printing device, for example, with blinking characters or warning-colored characters or is issued by voice independently from or with the characters. It is preferable that the second level warning assume greater urgency than the first level warning. For example, an increase of character's blinking frequency or sound volume can be considered. After confirming of the attachment of a new toner supply unit in response to the warning, the print control circuit 79 sets the data of toner supply number T and empty flag E at "0" again, ends the current control cycle, and returns to step S11 so as to wait for the next control cycle.

Figure 4:
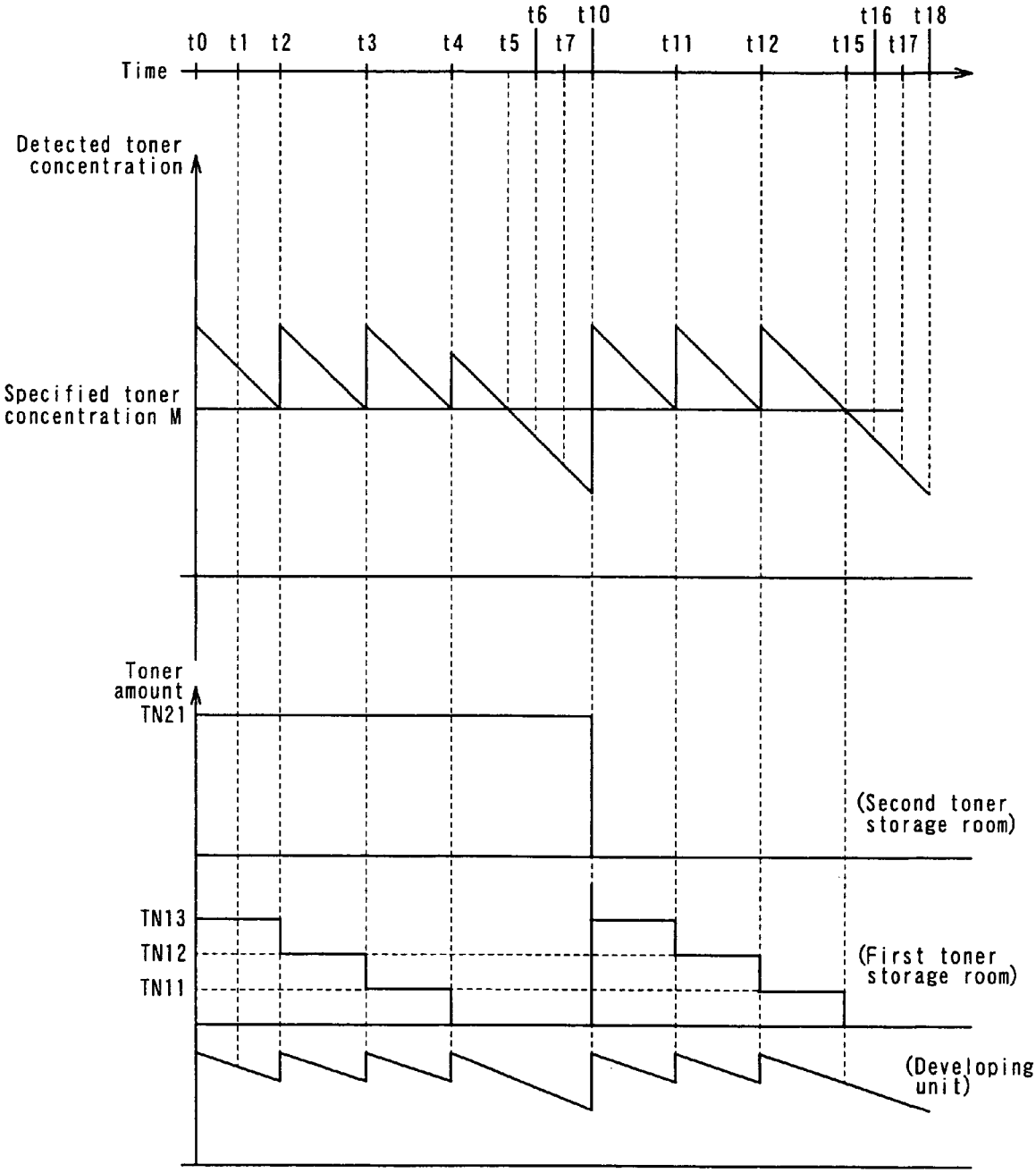
FIG. 4 is a time chart prepared to complement the explanation with the flowchart of FIG. 3 and showing operation of the printing device shown in FIG. 1.

Note that, in FIG. 4, while the second toner storage room 12 retains toner with toner amount TN 21 from time t0 to before t10, the toner amount in the second toner storage room 12 becomes "0" at time t10 since the toner in the second toner storage room 12 is moved to the first toner storage room at time t10. While the first toner storage room 11 retains, at the beginning, toner with toner amount TN 13, the toner amount in the first toner storage room 11 is decreased stepwise to toner amount TN12, to TN11, finally to 0, since a predetermined amount of toner is supplied to the developing unit 20 at times t2, t3, and t4. The toner amount stored in the developing unit 20 is changed in accordance with the toner concentration detected in each time by the toner concentration sensor 30. It can be seen from the above that the toner concentration sensor 30 performs a primary role to detect the concentration of the toner stored in the developing unit 20, as well as, a role to detect a toner remaining amount that has been conventionally performed.

Figure 6A:
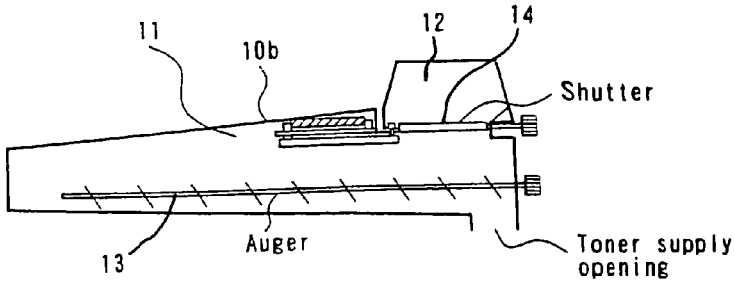
FIG. 6A is a view showing a second example of the toner supply unit shown in FIG. 1.
Figure 6B:
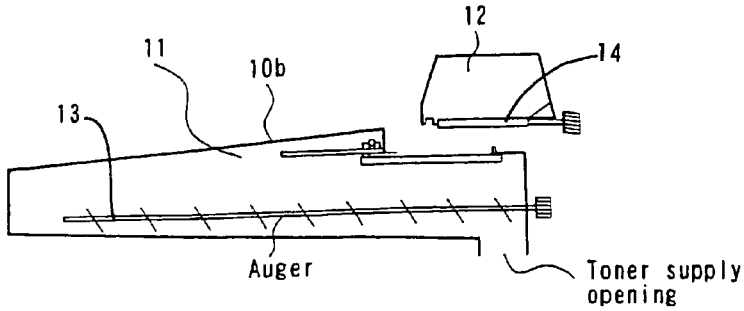
FIG. 6B is a view showing a state in which a second toner storage room is detached from a first toner storage room in the toner supply unit shown in FIG. 6A.

Toner supply units proposed in addition to the toner supply unit shown in FIG. 5 will be described with reference to FIGS. 6 to 8. In a toner supply unit 10*b* shown in FIG. 6A, the first and second toner storage rooms are partitioned by a shutter. When toner is moved from the second toner storage room 12 to the first toner storage room 11, the second toner supply mechanism 14 is driven to open the shutter. In this case, it is preferable that the second toner storage room 12 be attached to the first toner storage room 11 in a detachable manner as shown in FIG. 6B.

Figure 7:
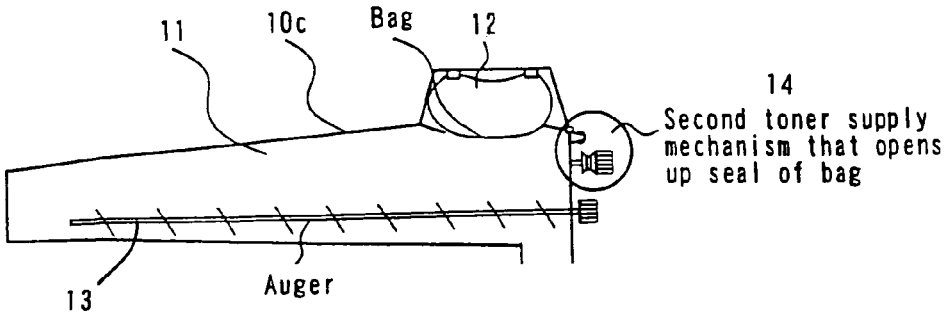
FIG. 7 is a view showing a third example of the toner supply unit shown in FIG. 1.
Figure 8:
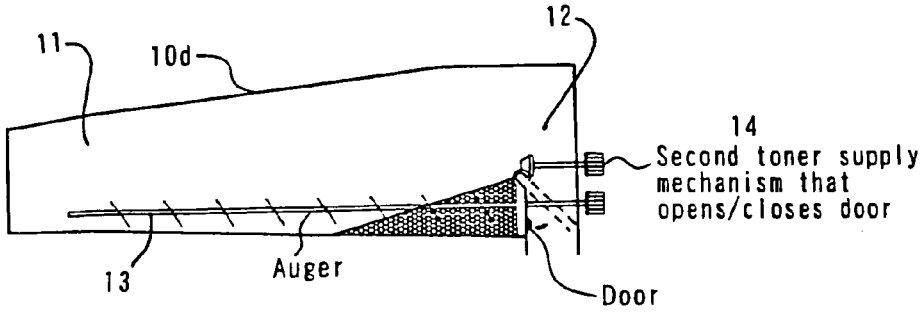
FIG. 8 is a view showing a fourth example of the toner supply unit shown in FIG. 1.

A toner supply unit 10*c* shown in FIG. 7 stores the toner in a bag in the second toner storage room 12. The bottom of the bag is sealed through a thin corded member. When the second toner supply mechanism 14 is driven, the seal through the corded member is opened up and all the toner in the second toner storage room 12 falls into the first toner storage room 11 at once. A toner supply unit 10*d* of FIG. 8 is not partitioned into the first and second toner storage rooms by hardware. The area at which toner stays when a door is closed functions as the second toner storage room 12 and the remaining area functions as the first toner storage room 11. The toner stored in the area corresponding to the first toner storage room 11 is supplied to the developing unit 20 in such a manner to get over the closed door. When the door is opened, the toner stored in the area corresponding to the second toner storage room 12 is supplied to the developing unit 20 through the opened door.

As described above, in the printing device 100, the print controller 70 can detect a toner concentration in the developing unit 20 through the toner concentration sensor 30 provided at the outside of the developing unit 20 and can determine whether the toner in the developing unit 20 is out or not using the detection result. This eliminates the conventional need of disposing the toner concentration sensor 30 in a narrow developing unit 20 or the need of disposing the toner remaining amount detection sensor in the toner supply unit. Further, it is possible to detect reduction in the amount of toner every time the toner in the developing unit 20 is out by the toner concentration sensor disposed at the outside of the developing unit 20, thereby detecting reduction in the usable amount of toner stepwise and issuing an adequate warning whose level is changed depending on the detection result. Thus, the printing device meets the need for miniaturization and is capable of favorably performing printing operation and maintenance work.

In the embodiment of the present invention described above, a function (program) that carries out the invention is previously recorded within the printing device. The configuration of the present invention is not limited to this. The same function may be downloaded to the device through a network or may be obtained from a recording medium, which may be installed in the device, on which the function is stored. It is possible to use any recording medium such as a CD-ROM as long as it can store a program and it can be read by the printing device. The function obtained by previous install or download as described above may realize its function in collaboration with an OS (Operating System) in the device and the like.

What is claimed is:

1. A printing device comprising:

an electrostatic latent image forming unit that is configured to form an electrostatic latent image of an image to be printed;

a developing unit that is configured to develop the electrostatic latent image formed by the electrostatic latent image forming unit using retaining toner while being supplied with toner;

a toner concentration sensor that is configured to detect the concentration of the toner retained in the developing unit;

a cartridge type toner supply unit detachably attached to the printing device, the toner supply unit comprising:

first and second toner storage rooms each of which is configured to store toner;

a first toner supply mechanism that is configured to feed the toner stored in the first toner storage room to the developing unit; and a second toner supply mechanism that is configured to feed the toner stored in the second toner storage room to the first toner storage room; and a controller that is configured to selectively perform first and second operations based on the toner concentration detected by the toner concentration sensor, wherein the first operation includes driving the first toner supply mechanism to feed the toner stored in the first toner storage room to the developing unit, wherein second operation includes driving the second toner supply mechanism to feed the toner stored in the second toner storage room to the first toner storage room, and wherein the toner concentration sensor is disposed externally of the developing unit.

2. The printing device according to claim 1, wherein the controller is configured to perform: (a) the first operation such that the toner concentration detected by the toner concentration sensor corresponds to a normal concentration previously specified; and (b) the second operation when the normal concentration cannot be obtained in spite of the first operation being performed by a specified number of times.

3. The printing device according to claim 1, wherein the toner concentration sensor is configured to measure the concentration of the toner on a sleeve of the developing unit from outside of the developing unit to detect the concentration of the toner retained in the developing unit.

4. The printing device according to claim 1, wherein the controller is configured to issue a first level warning at the time of performing the second operation.

5. The printing device according to claim 1, wherein the controller is configured to: (a) determine that the toner supply unit must be exchanged when the toner concentration detected by the toner concentration sensor does not reach a previously specified normal concentration in spite of performing the second operation: and (b) issue a second level warning.

6. The printing device according to claim 1, wherein the print controller is configured to issue a second level warning in a more urgent manner than in a case of a first level warning.

7. The printing device according to claim 6, wherein the print controller is configured to prohibit printing operation simultaneously with the second level warning.

8. The printing device according to claim 1, wherein the first toner supply mechanism includes, in the first toner storage room, a first auger to feed toner to a supply opening facing the developing unit while stirring the toner, and wherein the second toner supply mechanism includes, in the second toner storage room, a second auger to feed toner to a supply opening facing the first toner storage room while stirring the toner.

9. The printing device according to claim 1, wherein the first toner supply mechanism includes, in the first toner storage room, an auger to feed toner to a supply opening facing the developing unit while stirring the toner, and wherein the second toner supply mechanism is a shutter system in which the first and second toner storage rooms are partitioned by a shutter and all of the toner stored in the second toner storage room falls into the first toner storage room at once when the shutter is opened.

10. The printing device according to claim 1, wherein the first toner supply mechanism includes, in the first toner storage room, an auger to feed toner to a supply opening facing the developing unit while stirring the toner, wherein the toner in the second toner storage room is stored in a bag, wherein a bottom of the bag is sealed through a thin corded member, and wherein when the second toner supply mechanism is driven, the seal through the corded member is opened and all of the toner in the second toner storage room falls into the first toner storage room at once.

11. A printing program executed by a computer of a printing device including: a developing unit that is configured to develop an electrostatic latent image formed by an electrostatic latent image forming unit using retaining toner while being supplied with toner; a toner concentration sensor that is configured to detect the concentration of the toner retained in the developing unit; and a cartridge type toner supply unit detachably attached to the printing device, the toner supply unit having first and second toner storage rooms each of which is configured to store toner, a first toner supply mechanism that is configured to feed the toner stored in the first toner storage room to the developing unit, and a second toner supply mechanism that is configured to feed the toner stored in the second toner storage room to the first toner storage room, the program allowing the computer of the printing device to execute:

a concentration detection step of detecting a toner concentration using the toner concentration sensor; and a toner supply step of selectively performing first and second operations based on the toner concentration detected in the concentration detection step, wherein the first operation includes driving the first toner supply mechanism to feed the toner stored in the first toner storage room to the developing unit, wherein second operation includes driving the second toner supply mechanism to feed the toner stored in the second toner storage room to the first toner storage room, and wherein the toner concentration sensor is disposed externally of the developing unit.

12. The program according to claim 11, wherein, in the toner supply step, the first operation is performed such that the toner concentration detected by the toner concentration sensor corresponds to a normal concentration previously specified and the second operation is performed when the normal concentration cannot be obtained in spite of the first operation being performed by a specified number of times.

13. The program according to claim 11, wherein, in the toner supply step, a first level warning is issued at the time when the second operation is performed.

14. The program according to claim 11, wherein the program also allows the computer of the printing device to execute a warning step of (a) determining that the toner supply unit must be exchanged when the toner concentration detected by the toner concentration sensor does not reach a previously specified normal concentration in spite of the second operation being performed in the toner supply step; and (b) issuing a second level warning.

15. The program according to claim 14, wherein, in the warning steps, printing operation is prohibited simultaneously with the second level warning.

16. The printing device according to claim 1, wherein a toner remaining amount sensor is not disposed in the toner supply unit.

17. The program according to claim 11, wherein a toner remaining amount sensor is not disposed in the toner supply unit.

* * * * *